US007543629B2

(12) United States Patent
Chin et al.

(10) Patent No.: US 7,543,629 B2
(45) Date of Patent: Jun. 9, 2009

(54) TYPE OF LOOP HEAT CONDUCTING DEVICE

(75) Inventors: Chi-Te Chin, Hsinchu (TW); Chih-Sheng Wang, Taipei (TW); Tang-Hung Tu, Taoyuan County (TW)

(73) Assignee: Yeh-Chiang Technology Corp., Yangmei (TW)

( * ) Notice: Subject to any disclaimer, the term of this patent is extended or adjusted under 35 U.S.C. 154(b) by 332 days.

(21) Appl. No.: 11/416,031

(22) Filed: May 2, 2006

(65) Prior Publication Data

US 2007/0187072 A1 Aug. 16, 2007

(30) Foreign Application Priority Data

Feb. 14, 2006 (TW) ..... 95104867 A

(51) Int. Cl.
*F28D 15/00* (2006.01)
*H05K 7/20* (2006.01)

(52) U.S. Cl. ..... 165/104.21; 165/104.26

(58) Field of Classification Search ..... 165/104.21, 165/104.26, 104.33, 108; 361/700; 257/715; 174/15.2

See application file for complete search history.

(56) References Cited

U.S. PATENT DOCUMENTS 5,725,049 A * 3/1998 Swanson et al. ..... 165/104.26
6,330,907 B1 * 12/2001 Ogushi et al. ..... 165/104.26
6,450,132 B1 * 9/2002 Yao et al. ..... 122/366
2003/0042009 A1 * 3/2003 Phillips ..... 165/104.26
2003/0178184 A1 * 9/2003 Kroliczek et al. ..... 164/104.26
2004/0206480 A1 * 10/2004 Maydanik et al. ..... 165/104.26
2005/0067155 A1 * 3/2005 Thayer et al. ..... 165/172

FOREIGN PATENT DOCUMENTS

JP 2002340489 A * 11/2002
TW 9421100 12/2005

* cited by examiner

*Primary Examiner*—Tho v Duong
(74) *Attorney, Agent, or Firm*—Bucknam and Archer

(57) ABSTRACT

This invention relates to a type of loop heat conducting device, comprising an evaporator and a condenser which are connected together by means of a loop pipe, in order to form a cyclic loop for a liquid working medium, wherein the evaporator has a wick network core, and multiple tunnels are formed on the wick network core, and one end of the tunnels converges at a vapor chamber and is connected to a loop pipe to form a gaseous working medium outlet, and the terminal end of the pipe extends into and comes into contact with the internal part of the wick network core, and a compensation chamber for liquid working medium is formed on the upper section of the wick network core. Consequently, the cyclic loop that separates the gas and liquid enables the optimal heat dissipation capacity, and also has a structure that is simplified, thereby allowing for easy mass production.

10 Claims, 5 Drawing Sheets

TYPE OF LOOP HEAT CONDUCTING DEVICE

TECHNICAL FIELD

This invention relates to a type of heat conducting device, particularly a type of loop heat conducting device, wherein an evaporator and a condenser are connected together by means of a loop pipe in order to form a cyclic loop for a liquid working medium, and there is a vapor chamber and a compensation chamber that are installed in the evaporator to separate the liquid and gas, thereby achieving an optimal heat dissipation capacity.

BACKGROUND OF THE INVENTION

Following advances in technology, the development of electronic products has been growing rapidly. With a trend that is moving towards lighter, thinner, shorter, smaller and finer products, and increasingly high requirements for the product functions, the corresponding power that is used also becomes increasingly high. With the requirements for smaller size and more power, the concentration of heat generation over the surface of the electronic components will also increase rapidly, and the related heat management issue becomes very urgent to deal with. The aforesaid can be verified by looking at the heat accumulation effects of a high-power chip, such as CPU, VGA card, north/south bridge chip sets, and communication device in a computer. Accordingly, finding a solution for the heat dissipation issue within a limited area in order to ensure that the product functions normally is a crucial technological issue that needs to be solved today as well as a requirement for product commercialization. Due to the good heat conduction ability of traditional heat pipes, they have been widely used in the electronic part cooling, such as in the heat dissipation in the computer CPU. Attaching a wick structure to the entire internal walls of the heat pipe provides the capillary force for the back-flow of the liquid working medium, but the flow resistance inside the wick structure also contributes significantly to pressure drops in the fluid flow. Consequently, there is a significant reduction in performance under certain operating conditions.

In order to increase the heat conduction ability of traditional heat pipes, a loop heat pipe (LHP) has been introduced as a relatively new heat conduction concept. FIGS. 11 and 12 show the operating principles of a commonly-known loop heat pipe, comprising an evaporator (1'), a vapor section (2*a*'), a condenser (3'), a back-flow section (2*b*') and a compensation chamber (1*a*'). There is a wick structure (1*b*') inside the evaporator (1'). There are many grooves (vapor passages) (10') on the wall of the evaporator (1') or the wick structure (1*b*'), as shown in FIG. 12. The basic working principle is as follows: The wick structure (1*b*') itself is able to absorb liquid and cause the wick structure (1*b*') to be filled with a liquid working medium. When heat is added to the evaporator (1'), the wick structure (1*b*') will be heated up as well, and the liquid in the wick structure (1*b*') will be evaporated to become vapor and carry away the heat. As the vapor flows along the vapor section (2*a*') and arrives at the condenser (3'), the vapor will be condensed to become a liquid, and the capillary force of the wick structure (1*b*') will cause the liquid to flow along the back-flow section (2*b*') to the compensation chamber (1*a*') and arrive at the wick structure (1*b*'). Consequently a cyclic loop is formed. The driving force for the circulation of the working medium inside the loop pipe comes primarily from capillary force that is generated in the wick structure (1*b*'). Therefore the capillary force must be bigger than the pressure drop from the flow of the working medium around the different components of the system, in order to ensure the stable operation of the system. This is known as the capillary limit. If the flow caused by the heat input exceeds the capillary limit, a dry out phenomenon will occur in the loop pipe, which results in stultification of the working medium.

SUMMARY OF INVENTION

The development of the performance of traditional heat-conducting pipes has already reached a limit, and the commonly-known loop heat pipes (LHP) are limited by small scale production and high costs, and are therefore not widely used in the electronics industry. Consequently, the main objective of the present invention is to provide a type of loop heat conducting device that has a simplified structure, is easy to mass produce, has low costs and is able to achieve an optimal heat dissipation performance.

In order to achieve the aforesaid objective as well as other objectives, the present invention introduces a type of loop heat conducting device, comprising an evaporator and a condenser which are connected together by means of a loop pipe, in order to form a cyclic loop for a liquid working medium, wherein the evaporator has a wick network core, multiple tunnels being formed on the wick network core, one end of the tunnels converging at a vapor chamber and being connected to a loop pipe to form a gaseous working medium output end, the terminal end of the pipe extending into and coming into contact with the internal part of the wick network core, a compensation chamber for liquid working medium being formed on the upper section of the wick network core.

In the heat conducting device of the present invention, the wick network core is contained only inside the evaporator, wherein a vapor chamber and a compensation chamber are formed inside the evaporator, and makes use of a circulation principle based on the separation of gas and liquid, and a smooth pipe is used as the transmission path. In comparison with the traditional wick pipe core that makes up almost the entire pipe route, the flow of the liquid working medium through the inside of the wick network core merely takes up a small portion of the entire route. This enables the capillary force to be increased, and also avoids an increase in the flow resistance of the liquid working medium inside the wick network core, thereby solving the issues of anti-gravitational operations and the flow resistance from long-distance heat transmission. The biggest difference from the traditional heat pipes is that the loop heat conducting device in the present invention is based on the design of separation of liquid and gas passages, such that the direction of the vapor flow is parallel to the condensed liquid working medium, thereby solving the entrainment limit issue of traditional heat pipes. Consequently, it is able to take on a wattage that is higher than the heat pipe, and achieve the optimal heat dissipation performance. Furthermore, as the pipe route does not take on a definite shape, different designs can be carried out based on the different requirements. It is very flexible, and able to meet the current trends of high performance and light, thin and small devices in the electronics industry. This is another objective of the present invention.

In the present invention, the wick network core can be separately sintered, and the heat conducting device can be manufactured at a temperature that is not high. This is able to guarantee the structural strength, evenness, flatness and stability of the heat conducting device. Furthermore the structure is simplified, easy to mass produce, and the production cost is low. This is yet another objective of the present invention.

BRIEF DESCRIPTION OF DRAWINGS

The invention will be more clearly understood by the following detailed description in conjunction with the drawings wherein.

DETAILED DESCRIPTION OF PREFERRED EMBODIMENTS

The embodiments of the present invention will be described in detail below, but it should be understood that these embodiments are merely the relatively preferred embodiments of the present invention and do not limit the scope of the present invention. The best understanding can be obtained by reading the explanation of the embodiments set out below in conjunction with the diagrams.

Figure 2:
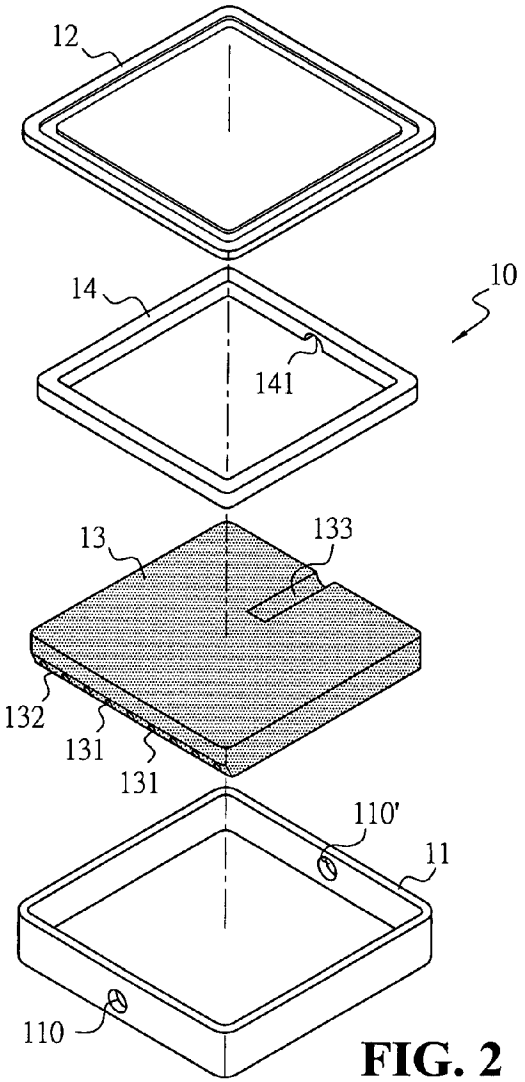
FIG. 2 shows a perspective view of the disassembled state of an evaporator in FIG. 1.
Figure 1:
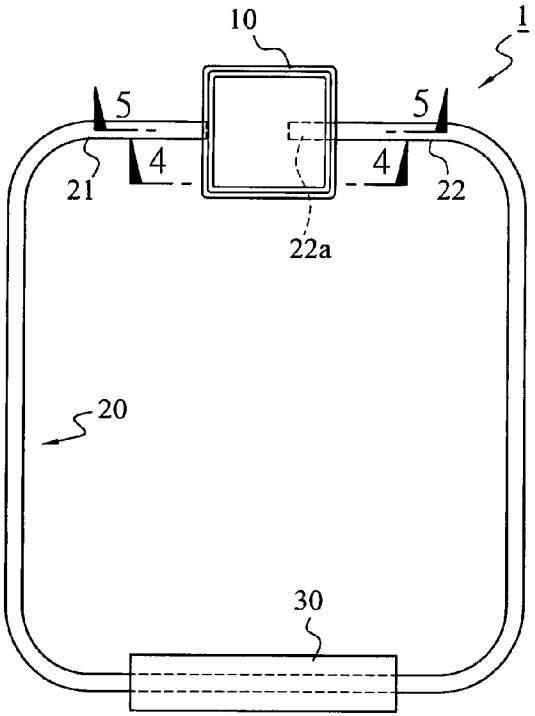
FIG. 1 shows the two-dimensional schematic view of an embodiment of the loop heat conducting device in the present invention.
Figure 4:
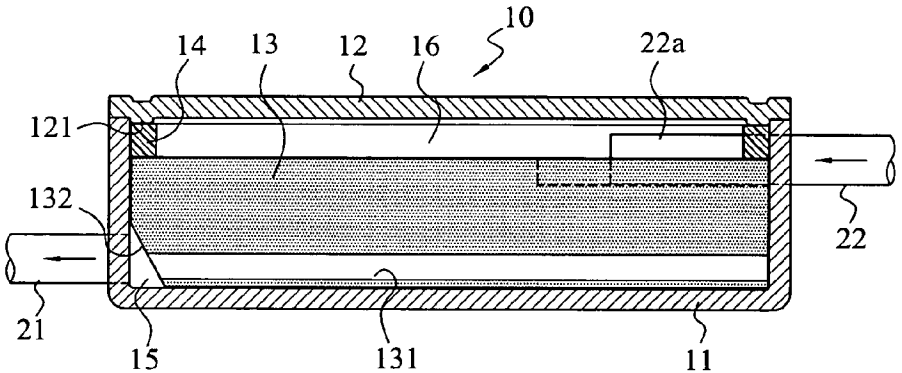
FIG. 4 shows a cross-sectional view taken along line 4-4 of FIG. 1, demonstrating the implementation state of the first embodiment of wick network core.
Figure 5:
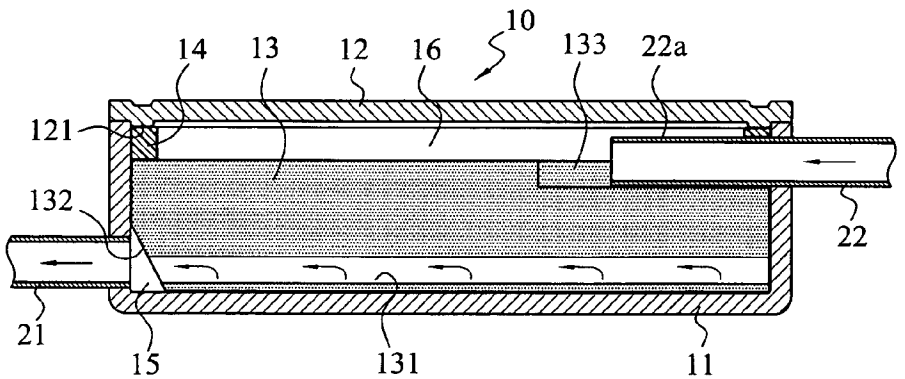
FIG. 5 shows a cross-sectional diagram of FIG. 1 across the 5-5 direction, demonstrating the implementation state of the first embodiment of wick network core.
Figure 3:
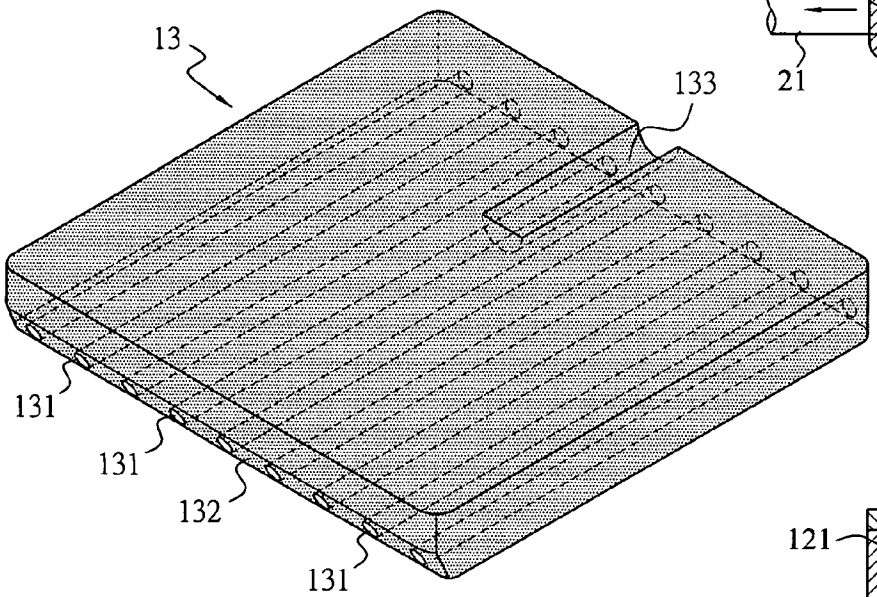
FIG. 3 shows an enlarged perspective view of the first type of wick network core in FIG. 2.

First, FIGS. 1 to 5 show an embodiment of the loop heat conducting device in the present invention (1). As shown in FIG. 1, the device primarily comprises an evaporator (10) and a condenser (30) which are connected together by means of a loop pipe (20), in order to form a cyclic loop for a liquid working medium. FIG. 2 shows a perspective view of the disassembled state in an evaporator (10) in the present invention and FIG. 3 shows an enlarged perspective view of the first type of wick network core (13) in the present invention. FIGS. 4 and 5 shows the cross-sectional diagrams for the application of the aforesaid wick network core (13) in the loop heat conducting device in the present invention (1).

In the present invention, the evaporator (10) is a flat heat spreader which comprises a casing (11) of rectangular shape and a cover section (12). The casing (11) and the cover section (12) are made from heat conducting materials such as copper, nickel or titanium or their alloys, and the two parts are tightly joint together to form an airtight space. A wick network core (13) is manufactured by sintering the powder of heat conducting materials such as copper, nickel or titanium or their alloys to form a porous structure, which is installed in the aforesaid space, and is tightly connected to the bottom section and the side walls. Several parallel tunnels (131) are installed on the internal part of the bottom section wick network core (13), and the lower part of the wick network core (13) forms a truncated corner (132) along the horizontal direction of the tunnels (131). The truncated corner (132) forms a vapor chamber (15) that is connected to the tunnels (131) in the space between the bottom section and the side walls. One end of the loop pipe (20) is connected at the round hole (110) of the casing (11), and communicated with the vapor chamber (15) to form an outlet (21) for the gaseous working medium. Another end of the loop pipe (20) is connected to a condenser (30) such as a water-cooled heat exchanger or an air-cooled heat exchanger (heat dissipation fin), and forms a liquid working medium inlet (22) which passes through the round hole (110') of the casing (11) and enters into the evaporator (10). A compensation chamber (16) is located on the upper part of the wick network core (13) and between the wick network core (13) and the cover section (12), and forms a buffer trough for the liquid working medium. The compensation chamber (16) is designed with a buffer lining (14) made from materials such as silicon, which is provided along the internal peripheral edge of the casing (11), enabling a compensation chamber (16) space to be maintained between the wick network core (13) and the cover section (12). In addition, the peripheral edge of the cover section (12) has a corresponding protruding edge (121) that protrudes out from the inside of the casing (11) and presses against the upper part of the buffer lining (14), thereby causing the wick network core (13) and the casing (11) to be tightly joint together. In addition the end point (22*a*) of the aforesaid pipe inlet (22) is installed at the upper part of the wick network core (13), or extends into the wick network core (13) (not shown in the diagram). As shown in FIG. 4, a depressed section (133, 141) that is uniform with the external diameter of the loop pipe (20) is respectively formed between the wick network core (13) and buffer lining (14). The end point (22*a*) of the aforesaid pipe inlet (22) extends through the depressed section (133, 141) and is located at the upper part of the wick network core (13), enabling the back-flow liquid working medium to be quickly absorbed by the wick network core (13), and producing a capillary driving force to maintain the circulation of the liquid.

Referring to FIG. 5 in contrast to FIG. 1, the inside of the evaporator (10) is evacuated and a working medium having interchangeability between liquid phase and gas phase is charged, such as water, liquid ammonia or ethanol. When the evaporator (10) absorbs heat from the outside, the liquid working medium inside the wick network core (13) is evaporated to become vapor. The vapor is at a saturated temperature at this point, and due to the sudden gas expansion, it gathers at the tunnel (131) where the pressure is relatively lower. However, the vapor is continually heated at the tunnel (131) and becomes superheated vapor, flowing along the tunnel (131) and entering into the vapor chamber (15). Due to the continual heating of the wick network core (13), the superheated vapor gradually becomes saturated vapor. At the same time, the expansion of the volume of the loop pipe (20) causes isothermal expansion of the superheated vapor that flow out through the outlet (21). After the saturated vapor enters into the condenser (30) and conducts heat exchange, part of the saturated vapor is condensed to become a liquid but it remains at a saturated state. The saturated liquid is continually cooled as it passes through the condenser (30) and becomes a subcooled liquid with low temperature, which flows along the loop pipe (20) towards the end with a lower pressure and flows back into the evaporator (10) through the inlet (22). As there is a loss of resistance during the backflow of the liquid working medium, the compensation chamber (16) is the lowest pressure point.

Furthermore, under the effect of the capillary force of the wick network core (13), the liquid working medium flows continually towards the compensation chamber (16) and permeates into the wick network core (13). At the same time, due to the continual heating of the wick network core (13), the heat is transferred back to the compensation chamber (16), until a steady state temperature is reached. The permeation of the liquid working medium flows from the compensation chamber (16) to the wick network core (13) undergoes a pressure drop and temperature increase process. Since the compensation chamber (16) is connected to the wick network core (13), its temperature is not at a minimum point. The liquid and gas phase inside the compensation chamber (16) coexist at a saturation point, and the liquid working medium in the wick network core (13) is continually heated until it reaches evaporated point. The vapor escapes from the wick structure and moves towards the tunnel (131). A gas-liquid phase cycle is thus created.

Figure 6:
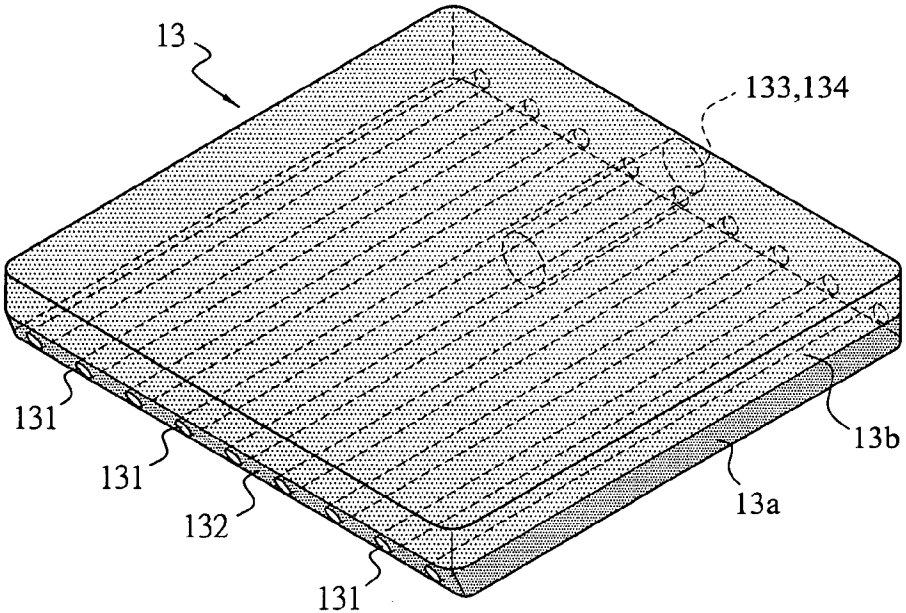
FIG. 6 shows a perspective view of the second embodiment of a wick network core in the present invention.
Figure 7:
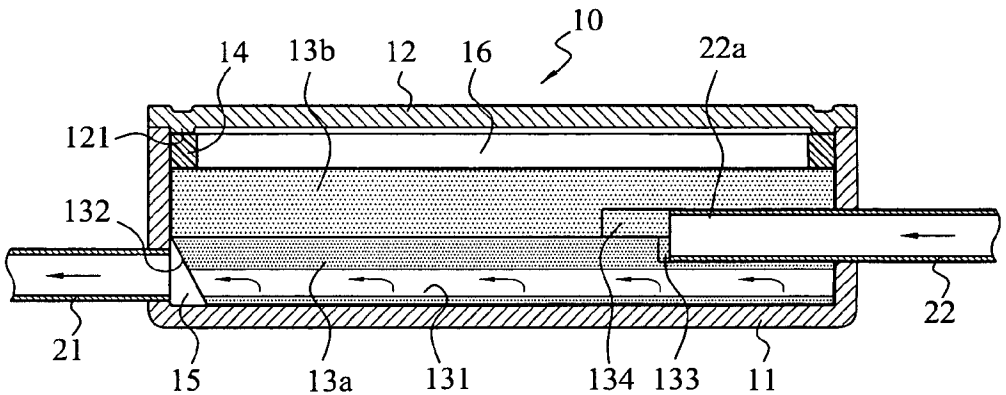
FIG. 7 shows a cross-sectional view of the implementation state of the second embodiment of the wick network core in FIG. 6.

In the present invention, the inventor considers that in ideal case the wick network core should have a relatively high capillary force and permeability, but a higher capillary force will require a smaller pore diameter, and a smaller pore diameter will mean a lower permeability. In order to achieve the optimal balance for the capillary force and permeability, FIG. 6 shows a perspective view of the second embodiment for the wick network core (13) in the present invention, while FIG. 7 shows a cross-sectional view of the implementation state of the second embodiment for the wick network core (13) in the loop heat conducting device (1) of the present invention. The structural features of the present embodiment are basically the same as in the previous embodiment. The only difference is that the wick network core (13) is a porous structure having an upper and lower section with different pore densities, which are made respectively from the sintering of the powders of heat conducting material of two different types of fineness, such as copper, nickel, titanium and their alloys. The first core (13*a*) on the lower section is a wick network with small and dense gas pores that are sintered from fine powder, giving it an optimal capillary force, while the second core (13*b*) on the upper section is a wick network with relatively larger pores that are sintered from relatively coarser powder, giving it an optimal permeability.

The first core (13*a*) has a plurality of parallel tunnels (131) provided along the inner side of the bottom section forms a truncated corner (132) is formed along one side of the first core (13*a*) in the perpendicular direction of the tunnels (131). The truncated corner (132) links up with the inner space bottom section and side walls of the casing (11) to form a vapor chamber (15) which is located between the tunnels (131) and the pipe outlet (21).

Figure 9:
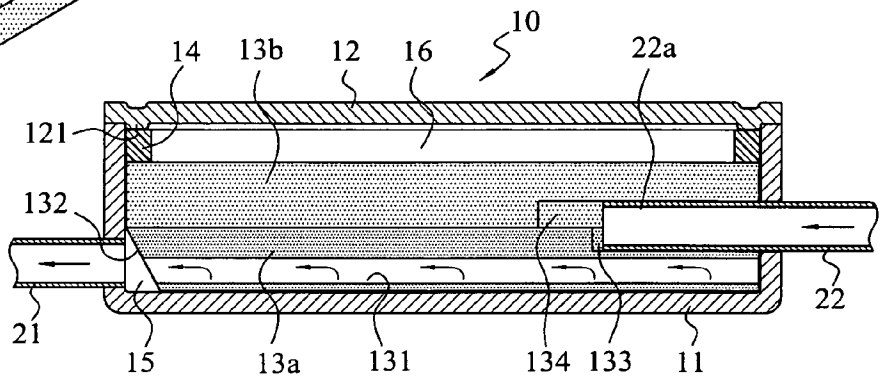
FIG. 9 shows a cross-sectional diagram of the implementation state of the third embodiment for the wick network core in FIG. 8.
Figure 8:
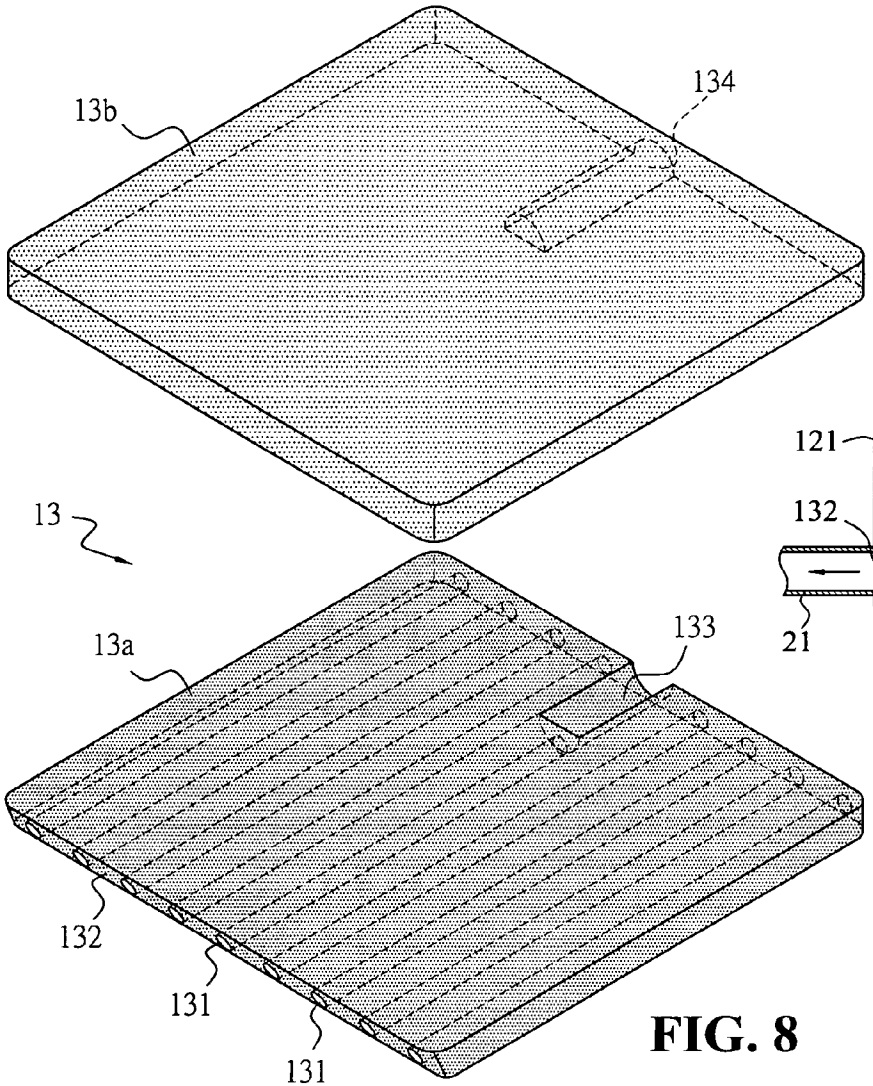
FIG. 8 shows a perspective view of the disassembled state of the third embodiment for a wick network core in the present invention.
Figure 10:
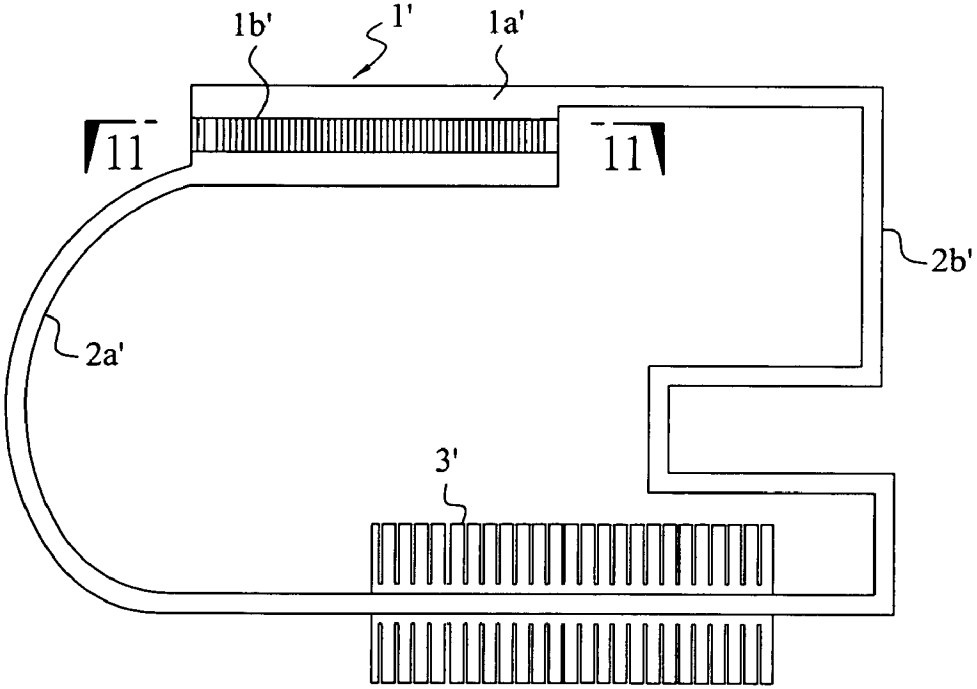
( PRIOR ART ) FIG. 10
FIG. 10 shows a prior-art two-dimensional diagram of a standard loop heat pipe.
Figure 11:
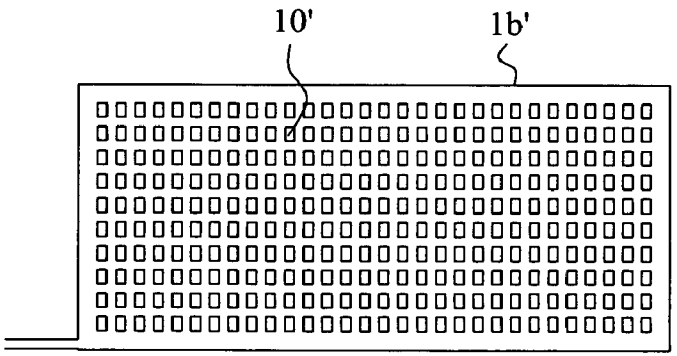
( PRIOR ART ) FIG. 11
FIG. 11 shows the cross-sectional diagram along the line 11-11 of FIG. 10.

FIG. 8 shows a perspective view of the disassemble state of the third embodiment for a wick network core (13) in the present invention. FIG. 9 shows the cross-sectional view of the implementation state of the third embodiment for the wick network core (13) of the loop heat conducting device (1) in the present invention. The present embodiment also comprises two porous structures with different pore density. The only difference from the second embodiment is that the wick network structure (13) is formed by stacking the first core (13*a*) at the lower section and the second core (13*b*) at the upper section together, in order to provide the capillary force and liquid flow passage required for the liquid cycle. Based on the present invention, the first core (13*a*) and the second core (13*b*) are porous structures with different pore densities, which are made respectively from the sintering of the powders of heat conducting materials of two different types of fineness, such as copper, nickel, titanium and their alloys. The first core (13*a*) at the lower section is a wick network with small and dense gas pores that is sintered from fine powder, giving it an optimal capillary force, while the second core (13*b*) on the upper section is a wick network with relatively larger pores that are sintered from relatively coarser powder, giving it an optimal permeability. The first core (13*a*) has a plurality of parallel tunnels (131) provided along the inner side of the bottom section, truncated corner (132) is formed along one side of the first core (13*a*) in the perpendicular direction of the tunnels (131). The truncated corner (132) links up with the inner bottom section and walls of the casing (11) to form a vapor chamber (15) which is located between the tunnels (131) and the pipe outlet (21).

As shown in FIGS. 7 and 9, the end point (22*a*) of the loop pipe inlet (22) extends into the first core (13*a*) and the second core (13*b*), or is located on top of the second core (13*b*) (not shown in the figure). As shown in the figure, a depressed section (133, 134) that is uniform with the external diameter of the loop pipe (20) is respectively formed between the first core (13*a*) and the second core (13*b*). The end point (22*a*) of the aforesaid pipe inlet (22) extends into and is located at the depressed section (133, 134). The second and third embodiments are basically the same as the first embodiment, and the working principle is the same and does not need to be mentioned again. The only point that is worth repeating is that in FIGS. 7 and 9, the evaporator (10) inside the loop heat conducting device (1) uses a complex sintered core, and a higher amount of water content is stored at the second core (13*b*) that has larger pores. Besides reducing the heat conduction coefficient, the porous network with a higher water content enables the resistance to increase as the vapor flows to the compensation chamber (16), thus ensuring that the vapor gathers at the tunnels (131). At the same time, the tunnels (131) are arranged at the bottom of the first core (13*a*), so that when the evaporator (10) comes into contact with the heat source, the vapor is able to gather quickly at the vapor tunnels (131) and quickly move to the pipe outlet (21). Under a relatively low load, there is the mutual function of liquid re-distribution at the area between the compensation chamber (16) and the condenser (30) in the loop heat conducting device, which gives the loop heat conducting device an auto regulation characteristic. With such a characteristic, the loop heat conducting device is able to have a variable heat resistance. In practical terms, the appropriate design parameters will solve the auto regulation action, and achieve an automatic temperature regulation by controlling the temperature of the back-flow liquid.

Summarizing the aforesaid, the present invention makes use of a gas-liquid separation design, in order to achieve an optimal heat dissipation performance, and furthermore it can be manufactured under a temperature that is not high. Consequently, the flatness, stability and reliability are guaranteed. The product has a simplified structure, is easy to mass produce, and requires a low production cost. It is therefore a novel, improved and highly applicable product.

The aforesaid embodiments are the relatively preferred embodiments which do not intend to limit the present invention. Changes and modifications that are made within the scope of the present patent application shall continue to fall within the scope of the patent.

EXPLANATION OF MAIN COMPONENTS

01: loop heat conducting device in the present invention
10: evaporator
11: casing
12: cover section

121: protruding edge
13: wick network core
13*a*: First core
13*b*: Second core
131: tunnel
132: truncated corner
133: depressed section
134: depressed section
14: buffer lining
141: depressed section
15: vapor chamber
16: compensation chamber
20: loop pipe/pipe
21: outlet
22: inlet
22*a*: end point
30: condenser

We claim:

1. A type of loop heat conducting device (1), comprising an evaporator (10) and a condenser (30) which are connected together by means of a loop pipe (20), in order to form a cyclic loop for a liquid working medium, wherein said evaporator (10) comprises a pressure-filled airtight space formed from a casing (11) and a cover section (12), said casing (11) having a bottom section and side walls, said evaporator (10) further having a wick network core (13) tightly connected to said bottom section and side walls of said casing (11), a plurality of tunnels (131) being formed on said wick network core (13), one end of the tunnels converging at a vapor chamber (15) and being connected to said loop pipe (20) to form a gaseous working medium outlet (21), another end of said loop pipe (20) passing through the condenser (30) and forming a liquid working medium inlet (22) connected to said evaporator (10), the end point (22*a*) of the pipe (20) extending into and coming into contact with said wick network core (13) in a compensation chamber (16) for the liquid working medium formed at the upper section of a space located between said cover section (12) and said wick network core (13), said evaporator (10) further comprises a buffer lining (14) provided along the inner side edges of said casing (11), between said wick network core (13) and said cover section (12), the surrounding edge of the cover section (12) having a corresponding protruding edge (121) that protrudes out from the inside of said casing (11) and presses against the upper part of said buffer lining (14).

2. A type of loop heat conducting device (1) referred to in claim 1, wherein said casing (11) and said cover section (12) make use of a material selected from copper, nickel, titanium or their alloys.

3. A type of loop heat conducting device (1) referred to in claim 1, wherein said plurality of tunnels (131) are formed along the inner bottom section of said wick network core (13).

4. A type of loop heat conducting device (1) referred to in claim 3, wherein said wick network core (13) is sintered from the powder of one material selected from copper, nickel, titanium and their alloys.

5. A type of loop heat conducting device (1) referred to in claim 3, wherein a truncated corner (132) is formed at the lower end of one side of the wick network core (13), said truncated corner (132) linking up with the bottom section and side walls of said casing (11) to form said vapor chamber (15), said vapor chamber (15) being located between said tunnels (131) and said pipe outlet (21).

6. A type of loop heat conducting device (1) referred to in claim 3, wherein said end point (22*a*) of said loop inlet (22) extends into said wick network core (13).

7. A type of loop heat conducting device (1) referred to in claim 3, wherein said end point (22*a*) of said loop inlet (22) is located on the upper section of said wick network core (13).

8. A type of loop heat conducting device (1) referred to in claim 1, wherein the fluid working medium is selected from water, liquid ammonia or ethanol.

9. A type of loop heat conducting device (1) referred to in claim 1, wherein the condenser (30) is a water-cooled heat exchanger.

10. A type of loop heat conducting device (1) referred to in claim 1, wherein the condenser (30) is an air-cooled heat exchanger.

* * * * *